US005402617A

United States Patent [19]

Daw et al.

[11] Patent Number: 5,402,617

[45] Date of Patent: Apr. 4, 1995

[54] FLOOR PANEL FOR INDUSTRIAL CLEANROOM

[75] Inventors: Terry L. Daw, Murray; David F. Procter, Salt Lake City, both of Utah

[73] Assignee: Daw Technologies, Inc., Salt Lake City, Utah

[21] Appl. No.: 932,079

[22] Filed: Aug. 18, 1992

Related U.S. Application Data

[62] Division of Ser. No. 473,327, Feb. 1, 1990, Pat. No. 5,138,807.

[51] Int. Cl.[6] ..... E04C 2/38; E04B 5/48; E04F 15/06

[52] U.S. Cl. ..... 52/630; 52/220.5; 52/220.8

[58] Field of Search ..... 52/221, 177, 180, 660, 52/664, 666, 667, 668, 669, 126.6, 126.5, 630, 220.5, 220.8; 454/187

[56] References Cited

U.S. PATENT DOCUMENTS

| | | | |
|---|---|---|---|
| 3,003,055 | 10/1961 | Liberman | 52/668 |
| 3,057,271 | 10/1962 | Butler | 52/181 |
| 3,367,257 | 2/1968 | Raider | 454/187 |
| 3,503,166 | 9/1970 | Nakazawa et al. | 52/126.6 |
| 4,622,792 | 11/1986 | Betts | 52/777 |
| 4,693,173 | 9/1987 | Saiki | 454/187 |
| 4,699,640 | 10/1987 | Suzuki et al. | 454/187 |
| 4,897,299 | 1/1990 | Kawachi | 52/177 |

FOREIGN PATENT DOCUMENTS

| | | | |
|---|---|---|---|
| 705119 | 3/1954 | United Kingdom | 52/177 |

OTHER PUBLICATIONS

United Kingdom Printed Application 2136472A; Sep. 19, 1984.

*Primary Examiner*—Michael Safavi
*Attorney, Agent, or Firm*—Trask, Britt & Rossa

[57] ABSTRACT

A floor panel having a substantially planar upper tread surface comprises a cast grating having first and second pairs of substantially planar, external sidewalls with upper side edges of the sidewalls approximately coinciding with the upper tread surface;

a pair of substantially planar slats spaced closely adjacent to each other and extending from the first pair of opposite sidewalls across the frame, with the central, longitudinal planes of the slats being oriented substantially perpendicular to the upper tread surface of the floor panel and substantially parallel to each other, and further with upper side edges of the slats approximately coinciding with the upper tread surface, wherein the spacing between the slats is such that a fastener can be frictionally engaged between the slats for secure attachment to the slats;

a plurality of substantially planar ribs extending from the first pair of opposite sidewalls across the frame, and being spaced apart from each other and from the pair of slats; and a plurality of substantially planar cross ribs extending from the second pair of opposite sidewalls across the frame, and further being spaced apart from each other and forming common intersections with the ribs and said pair of slats.

6 Claims, 2 Drawing Sheets

FLOOR PANEL FOR INDUSTRIAL CLEANROOM

This is a division of application Ser. No. 07/473,327, filed Feb. 1, 1990, now U.S. Pat. No. 5,138,807.

BACKGROUND OF THE INVENTION

1. Field of the Invention

The present invention relates to floor panels or tiles which form a grid-like floor when laid over a support, such as a subfloor. The floor panels are ideally suited for suspended flooring in industrial structures which are to meet cleanroom specifications such as are required for the production of integrated circuit chips, electronic components and other products which are subject to contamination from airborne particles.

2. Prior Art

The advance of modern technology into the world of miniaturization has necessitated the development of unique manufacturing environments. For example, the preparation of multilayered, integrated computer chips includes the fabrication of wafer masks and layouts that include hundreds of tiny circuits whose operational condition depends upon the absence of foreign materials and very accurate placement of circuit components on the chips. These chips are prepared in an industrial cleanroom which is classified based upon the amount of microcontamination within the room. Examples of such clean rooms are shown in an earlier U.S. Pat. No. 4,667,579, issued May 26, 1987 and the related art mentioned in that patent.

Grid-like floors have been used in such structures, with the floor comprising panels or tiles which are supported on support posts at tile corners so as to form an air exchange plenum beneath the grid-like floor. These panels or tiles have been cast from such materials as iron, aluminum and composites, and have had a variety of geometric patterns.

The attachment of wall sections and other structures and equipment to such grid-like floor has typically been limited in attachment orientation to the particular geometric pattern of the grid openings. Molly bolt fasteners have been used to expand and couple equipment or structure to the bottom surface of the grid-like floor through such grid openings. Accordingly the position and orientation of the grid openings in the floor panels has been determinative of available positions for attached structures. The inadequacy of current grid-like floor structure to permit unlimited orientation of structures and equipment is further exacerbated by the frequent need to shift equipment position within an existing cleanroom facility. When an optimum rearrangement or modification of a cleanroom fabrication set up is precluded because of incompatible flooring, serious costs and consequences result. These include expensive structural modication to rebuild floor structure and loss profits due to down time.

In addition, the panels of the prior art have not had a symmetrical pattern which allows the tile to be laid in any orientation. Instead, conventional tiles are directional, meaning they must be laid in a specific orientation. Rotation of these tiles by 90° would be unacceptable because of resulting pattern non-uniformity. This limits versatility in floor layout because tile orientation becomes a factor. This non-uniformity in pattern also generates a non-uniform response to air flow distribution. In other words, flow distribution with respect to one orientation of a conventional pattern will not be the same for that pattern when rotated 90°.

Other shortcomings in current suspended floor tiles include excessive weight with only limited strength and excessive material leading to high cost. Further, there has been no provision for ready installation of utility boxes, for electrical air or water conduit, through the floor panels. Prior art practice required cutting openings in flooring to develop such service lines. Inasmuch as open space between the floor panels and the subfloor provides an advantageous space for running utilities such as electrical and telephone connections, it would be desirable to provide means for rapidly and easily inserting a utility box in the floor panels to accommodate such utilities.

3. Objectives

A principal objective of the present invention is to provide a novel floor panel or tile which is cast with a grid pattern which forms the upper tread surface of the floor when the panels or tiles are laid, with the open space in the grid pattern being up to 60% or greater, and wherein at least one pair of closely spaced, planar slats extend across the panel. The spacing between the slats is such that a threaded fastener and other fastening means can be engaged between the slats for quick and easy mounting of wall sections, posts, equipment apparatus, and other items to the floor.

Another objective of the present invention is to provide such floor panels or tiles which are symmetrical about their central axes, such that the floor panels or tiles can be laid in any orientation and order, with a consistent, uniform pattern and air flow being achieved for the laid floor.

A still further objective of the present invention is to provide a preformed, removable section in the floor panel which accommodates insertion of a utility box.

BRIEF DESCRIPTION OF THE INVENTION

The above objectives are achieved in accordance with the present invention by providing a novel floor panel having a substantially planar upper tread surface. The floor panel comprises a cast grating having first and second pairs of substantially planar, external sidewalls. The upper side edges of said sidewalls coincide with the upper tread surface. A pair of substantially planar slats which are spaced closely adjacent to each other extending from the opposite sidewalls across said frame, with the central, longitudinal planes of the slats being oriented substantially perpendicular to the upper tread surface of the floor panel and substantially parallel to each other. The upper side edges of the slats also coincide with the upper tread surface. The spacing between the slats is such that a threaded or snap-in fastener can be frictionally engaged between the slats for secure attachment to the slats. A plurality of substantially planar ribs extend from the first pair of opposite sidewalls across said frame, with the central, longitudinal planes of the ribs being substantially parallel with the central longitudinal planes of the slats. The upper side edges of said ribs coinciding with said upper tread surface, and the slats are spaced apart from each other and from said pair of slats. A plurality of substantially planar cross ribs extending from a second pair of opposite sidewalls across said frame, with the central, longitudinal planes of said cross ribs being substantially perpendicular to and substantially parallel to each other. The upper side edges of said cross ribs also coincide with said upper tread surface, and the cross ribs are spaced apart from each other and forming common intersections with said ribs and said pair of slats.

In a preferred embodiment, a pair of substantially planar second slats extend from the second pair of opposite sidewalls across the frame, with the pair of second slats being spaced closely adjacent to each other and with the central, longitudinal planes of the second slats being oriented substantially perpendicular to the upper tread surface of the floor panel and substantially parallel to each other. The upper side edges of said second slats also coincide with the upper tread surface. The spacing between the second slats is such that a threaded fastener can be frictionally engaged between the second slats for secure attachment no the second slats. The second slats form common intersections with the ribs and the pair of first slats.

The spacings between the closely spaced slats of the present invention provide ready means for quickly and easily attaching various items to the resulting floor. Wall plates, channels, ells, and brackets in addition to various equipment and apparatus can quickly be secured to the floor by engaging threaded fasteners with the closely spaced slats.

In a further preferred embodiment of the invention, the floor panel has sidewalls having the same longitudinal length such that the floor panel is essentially square. The two pair of closely spaced, planar slats extend between the midpoint of opposite pairs of sidewalls of the panel and meet at a common intersection at substantially the center of the panel to form four quadrants which are symmetrical about the respective pair of closely spaced slats. The ribs and cross ribs are spaced and oriented in the four quadrants so that the surface pattern that they form (the pattern of the tread surface of the panel) is also symmetrical about the respective pair of closely spaced slats. Thus, the floor panel can be laid in any orientation, and the pattern developed for the floor will be uniform and consistent.

Additional objects and features of the invention will become apparent from the following detailed description, taken together with the accompanying drawings.

THE DRAWINGS

A preferred embodiment of the present invention representing the best made presently contemplated of carrying out the invention is illustrated in the accompanying drawings in which.

Figure 1:
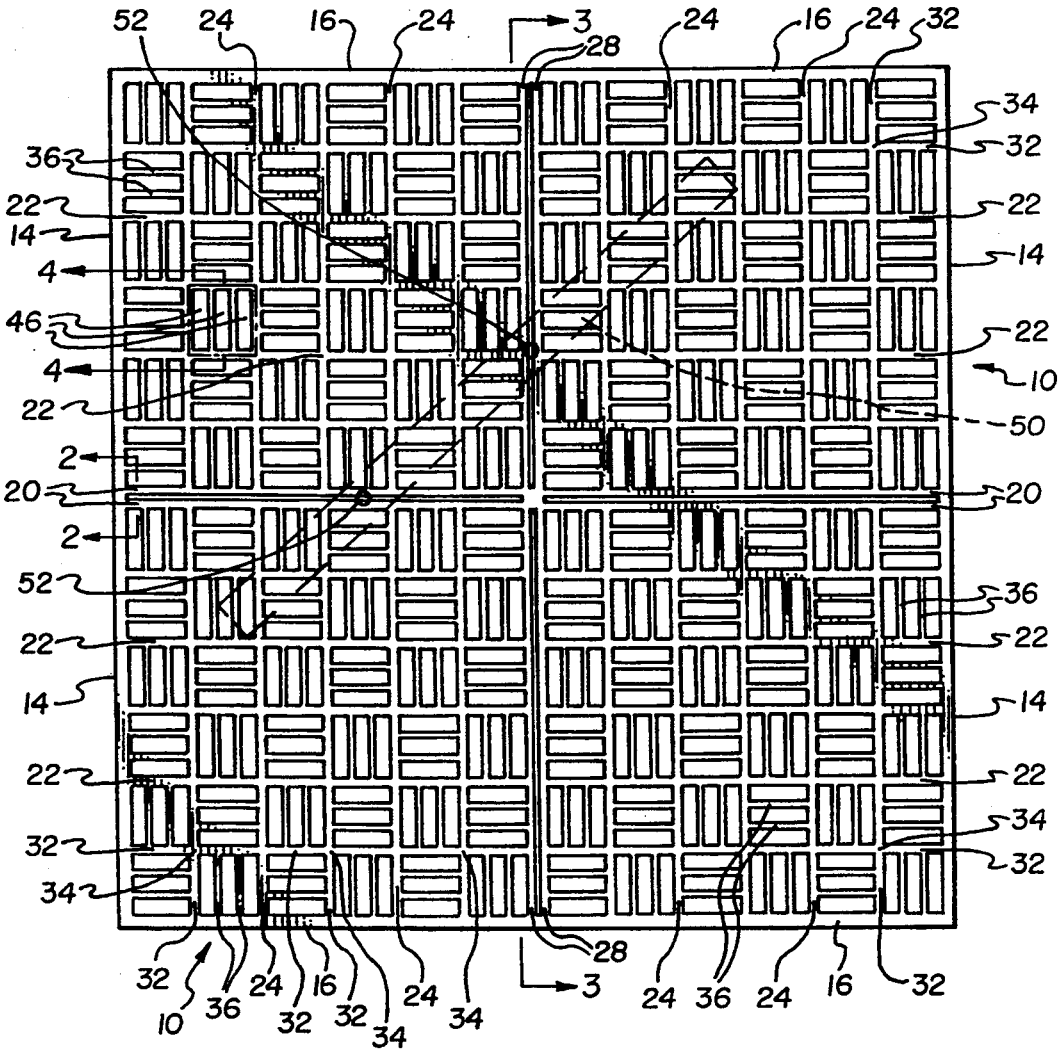
FIG. 1 is a top plan view of a single floor panel in accordance with the present invention.
Figure 4:
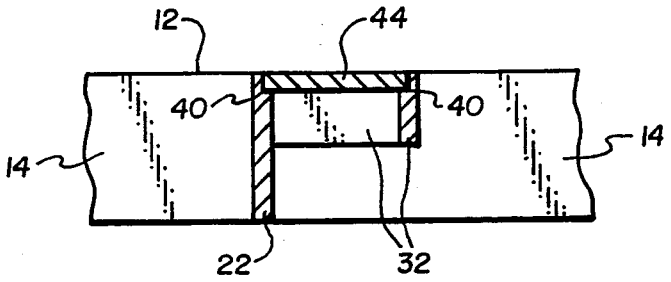

FIG, 3 is a cross sectional view taken along line 3—3 of FIG. 1; and FIG. 4 is a partial cross sectional view taken along line 4—4 of FIG. 1.

DETAILED DESCRIPTION OF THE ILLUSTRATED EMBODIMENT

Figure 3:
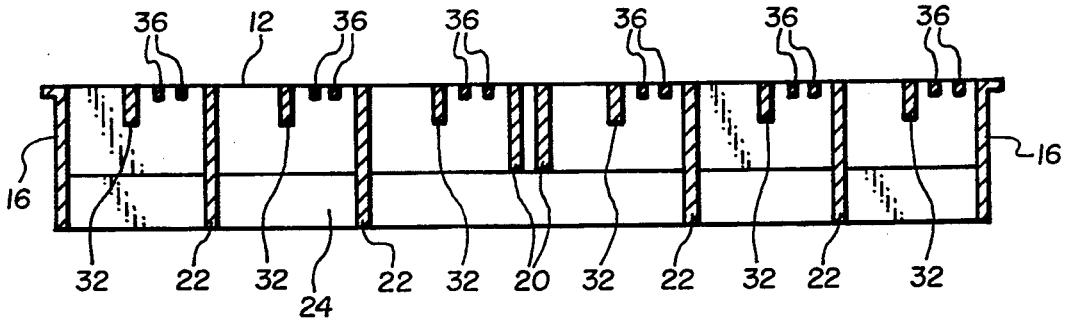

Referring to the drawings, there is shown a preferred embodiment of a floor panel 10 having a substantially planar upper tread surface 12 (FIG. 3). The floor panel 10 comprises a cast grating which is preferably made of aluminum. The panel 10 has an exterior periphery defined by first and second pairs of substantially planar, external sidewalls 14 and 16. The sidewalls 14 and 16 have central, longitudinal planes which are oriented substantially perpendicular to the upper tread surface 12 of the floor panel 10, with upper side edges of the sidewalls coinciding with the upper tread surface 12. As illustrated, the first and second pairs of opposite sidewalls 14 and 16 form a substantially rectangular external frame of the floor panel 10. The sidewalls 14 and 16 advantageously extend downward from the upper tread surface 12 by a distance of between about 1.5 to 3 inches, most preferably, about 2 inches. The sidewalls 14 and 16 have a thickness of between about 0.10 and 0.25 inch. Most preferably the sidewalls 14 and 16 taper, with the sidewalls being about 0.22 inch thick at the upper edge and tapering slightly to the lower edge.

Figure 2:
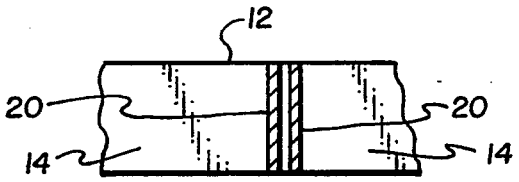
FIG. 2 is a partial cross sectional view taken along line 2—2 of FIG. 1.

A pair of substantially planar slats 20 which are spaced closely adjacent to each other extend from the first pair of opposite sidewalls 14 across the frame. The central, longitudinal planes of the slats 20 are oriented substantially perpendicular to the upper tread surface 12 of the floor panel as best shown in FIG. 2. The central planes of the slats 20 are also substantially parallel to each other. The upper side edges of the slats 20 coincide with the upper tread surface 12, and the spacing between the slats is such that a threaded fastener can be frictionally engaged between the slats 20 for secure attachment to the slats 20. Preferably, the spacing between the slats 20 is advantageously about 0.12 inch so that a one-eight inch threaded or snap-in fastener, which is slightly oversized (diameter of 0.125 inch), will make secure, frictional engagement with the inside edges of the slats 20. The screw flights of the fastener may actually penetrate into the inside edges of the slats 20.

The slats 20 need not extend from upper tread surface to the full depth of the sidewalls 14 and 16. Preferably, the slats 20 extend downwardly by a distance of between about 1.25 and 1.5 inches. The thickness of the slats 20 are similar to the thickness of the sidewalls 14 and 16, and the slats 20 preferably taper towards their free side edges. The slats 20 preferably have a thickness of about 0.215 inch at their side edges coinciding with the upper tread surface 12, and the slats can taper such that at the downwardly extending side edges, they have a thickness of about 0.156 inch.

A plurality of substantially planar ribs 22 extend from the first pair of opposite sidewalls 14 across the frame of the panel 10, with the central, longitudinal planes of the ribs 22 being substantially parallel with the central longitudinal planes of the slats 20 and with the upper side edges of said rids coinciding with the upper tread surface 12. The ribs 22 are further spaced apart from each other and from said pair of slats 20.

The ribs 22 are preferably spaced from each other and from the slats 20 and from the sidewalls 14 by a distance of between about 3.5 and 5 inches, preferably about 3.6 to 3.7 inches. The ribs 22 extend downwardly from the upper tread surface 12 a distance substantially the same as the extending distance of the sidewalls 14 and 16. The ribs 22 have thickness dimensions which are substantially the same as the sidewalls 14 and 16, and the ribs 22 may taper in the same manner as do the sidewalls 14 and 16.

A plurality of substantially planar cross ribs 24 extend from the second pair of opposite sidewalls 16 across said frame to be substantially perpendicular to the ribs 22. The central, longitudinal planes of the cross ribs 24 are substantially perpendicular to and substantially parallel to each other, and the upper side edges of the cross rids 24 coincide with the upper tread surface 12. The cross ribs are spaced apart from each other and from the sidewalls 16 by a distance which is the same as the spacing for the ribs 22, and the cross ribs 24 and form common intersections with the ribs 22 and the pair of slats 20. The cross ribs 24 have thickness dimensions which are substantially the same as those of the ribs 22, and the cross ribs 24 may taper in the same manner as do the ribs 22.

Although only one pair of closely spaced slats 20 are essential, it is preferable to provide a second pair of slats 28 which extend from the second pair of opposite sidewalls 16 and intersect the first pair of slats 20 at the center of the panel 10. The pair of second slats 28 are spaced closely adjacent to each other in similar manner to the first slats 20. The central, longitudinal planes of the second slats 28 are oriented substantially perpendicular to the upper tread surface 12 of the floor panel 10 and substantially parallel to each other. The upper side edges of said second slats 28 coincide with the upper tread surface 12. The spacing between the second slats 28 is the same as the spacing between the first plats 22. The second slats 28 form common intersections with the ribs 22.

The second set of slats 28, which are oriented at 90° with the first slats 20 are highly advantageous. As shown in FIG. 1, a wall plate 50 can be set at any orientation, and with the two sets of slats 20 and 28 there will be numerous places for fasteners 52 to be attached to the floor panel 10.

In the preferred embodiment as illustrated, the first and second sidewalls 14 and 16 have essentially the same longitudinal length so that the frame of the floor panel 10 is essentially square. The pair of substantially planar slats 20 extend between the midpoints of the first pair of opposite sidewalls 14, and the pair of substantially planar second slats 28 extend between the midpoints of the second pair of opposite sidewalls 16. The planar ribs 22 are equally spaced from each other, from the second pair of opposite sidewalls 16 and from the pair of slats 20, and the planar cross ribs 24 are equally spaced from each other, from the first pair of opposite sidewalls 14 and from the pair of second slats 28. In such an arrangement, the pair of slats 20 and the pair of second slats 28 extend from a common intersection at substantially the center of the floor panel 10 to form four quadrants which are symmetrical about the pair of slats 20 and the pair of second slats 28. The ribs 22 and cross ribs 24 form a plurality of substantially square domains in each quadrant.

It is advantageous to omit the pair of subribs 36 in at least one of the subdomains. Such a subdomain is shown in FIG. 4 of the drawings. A perimeter notch 40 is formed at the upper edge of the ribs 22, or cross ribs 24 and short ribs 32 which form the subdomain which has the pair of subribs removed, with the notch 40 facing that subdomain. A square plate 44 is provided having a peripheral edge that fits into the perimeter notch 40 of the subdomain which has the pair of subribs removed. The plate 44 covers the otherwise open space created by the removal of the subribs if the subribs of the subdomain, and the plate can be readily removed for installation of a utility box. The plate 44 preferably has cut out openings 46 therein (see FIG. 1) so as to simulate the subribs of adjacent subdomains.

Each of the square domains are divided into four subdomains by a pair of subribs 32 which form a common intersection 34 at substantially the center of each of the domains and extend from the common intersection to the midpoints of the respective sides (either ribs 22 or cross ribs 24) of each of the domains. The subribs 32 need not extend downwardly as far from the upper tread surface 12 as do the ribs 22 and cross ribs 24 as best shown in FIG. 3. The upper sides of the subribs 32 coincide with the upper tread surface 12 of the panel 10, but extend downwardly therefrom by a distances of between about 0.4 and 0.75 inches, most preferably about 0.65 inch. The thickness of the subribs 32 can be between about 0.165 and 0.225, and the subribs 32 preferably taper in a direction away from the upper tread surface 12 of the panel 10. At the side edges coinciding with the upper tread surface 12, the subribs 32 preferably have a thickness of about 0.219 inch, and at the downwardly extending side edges, the thickness is about 0.180 inch.

In the preferred, illustrated embodiment, each of the subdomains have two equally spaced, parallel short ribs 36 extending from one side of the subdomain to the opposite side of the subdomain. The orientation of the short ribs 36 in the subdomains are such that for any given subdomain, the short ribs 36 in subdomains adjacent to the sides of the given subdomain are oriented in a direction substantially perpendicular to the direction of the short ribs 36 in the given subdomain. This allows for complete symetry of the panel 10, and as one can see from FIG. 1, rotating the panel 10 by 90° results in the same exact pattern in the tread surface. Thus, the panels 10 can be installed without concern as to which sides are up or down. Any way the panel is installed, it will be uniform and consistent with the other panels being laid.

We claim:

1. A floor panel having a substantially planar upper tread surface, said floor panel comprising a cast grating having first and second pairs of substantially planar, external sidewalls with upper side edges of said sidewalls approximately coinciding with said upper tread surface, said first and second sidewalls having essentially the same longitudinal length so that the frame of said floor panel is essentially square;

a pair of substantially planar slats spaced closely adjacent to each other and extending from the midpoints of the first pair of opposite sidewalls across said frame, with the central, longitudinal planes of said slats being oriented substantially perpendicular to the upper tread surface of the floor panel and substantially parallel to each other, and further with upper side edges of said slats approximately coinciding with said upper tread surface, wherein the spacing between said slats is such that a fastener can be frictionally engaged between said slats for secure attachment to said slats;

a pair of substantially planar second slats extending from the midpoints of said second pair of opposite sidewalls across said frame, with the pair of second slats being spaced closely adjacent to each other and with the central, longitudinal planes of said second slats being oriented substantially perpendicular to the upper tread surface of the floor panel and substantially parallel to each other, and further with the upper side edges of said second slats approximately coinciding with said upper tread surface, wherein the spacing between said second slats is such that a fastener can be frictionally engaged between said second slats for secure attachment to said second slats, and further wherein said second slats form common intersections with said ribs and said pair of first slats;

a plurality of substantially planar ribs extending from the first pair of opposite sidewalls across said frame, and being spaced equally apart from each other and, from said pair of planar slats, and from the second pair of opposite sidewalls;

said ribs being spaced from each other, and from the first pair of opposite sidewalls and from the pair of second slab by a distance of between about 3.5 and 5 inches;

a plurality of substantially planar cross ribs extending from the second pair of opposite sidewalls across said frame, and further being equally spaced apart from each other, from the first pair of opposite sidewalls, and from the pair of second slats, and forming common intersections with said ribs and said pair of slats, the cross ribs being spaced from each other, and from the second pair of opposite sidewalls and from the pair of slats by a distance substantially the same as the spacing between said ribs;

wherein the pair of planar slats and the pair of second slats extend from a common intersection at substantially the center of said floor panel to form four quadrants which are symmetrical about the pair of slats and the pair of second slats;

wherein each of the square domains are divided into four subdomains by a pair of subribs which form a common intersection at substantially the center of each of said domains and extends from the common intersection to the midpoints of the respective sides of each of said domains;

wherein the pair of subribs in at least one of said subdomains are left out and a perimeter notch is formed at the upper edge of the ribs and cross ribs forming said subdomain which has the pair of subribs removed, with the notch facing that subdomain; and wherein a square plate is provided having a peripheral edge that fits into the perimeter notch of said subdomain which has the pair of subribs removed, whereby the plate covers the other otherwise open space created by the removal of the subribs of said subdomain, and the plate can be readily removed for installation of a utility box.

2. A floor panel in accordance with claim 1, wherein each of said subdomains have two equally spaced substantially parallel short ribs extending from one side of said subdomain to the opposite side of said subdomain.

3. A floor panel in accordance with claim 2, wherein the orientation of the short rids in said subdomains are such that for any given subdomain, the short ribs in subdomains adjacent to the sides of said given subdomain are oriented in a direction substantially perpendicular to the direction of the short ribs in the given subdomain.

4. A floor panel in accordance with claim 1, wherein said plate has cut out openings therein so as to simulate the subribs of adjacent subdomains.

5. A floor panel in accordance with claim 1 wherein the total tread surface is subdivided into component subdomains of equal dimension and wherein each subdomain has an equal number of slotted openings of common orientation and size, each subdomain having a slot orientation 90° offset from the slots of all adjacent subdomains, thereby creating a geometric pattern for the panel which permits its rotation through any multiple of 90° without resultant variation in the appearance of geometric design.

6. A floor panel in accordance with claim 5, wherein each subdomain comprises three slotted openings whose cumulative open surface area comprises at least 60% of the total surface area of the subdomain.

* * * * *